United States Patent [19]

Gurries

[11] 4,340,255

[45] Jul. 20, 1982

[54] RESONANTLY DRIVEN VERTICAL IMPACT SYSTEM

[75] Inventor: Raymond A. Gurries, Reno, Nev.

[73] Assignee: Resonant Technology Company, Sparks, Nev.

[21] Appl. No.: 157,138

[22] Filed: Jun. 5, 1980

[51] Int. Cl.[3] ..... E01C 23/09

[52] U.S. Cl. ..... 299/37; 173/49; 173/162 R; 299/14

[58] Field of Search ..... 299/14, 37; 173/49, 173/139, 162, 400; 404/133; 172/40; 37/DIG. 18

[56] References Cited

U.S. PATENT DOCUMENTS

| | | | |
|---|---|---|---|
| 1,841,802 | 1/1932 | Gettelman | 299/37 |
| 3,200,893 | 8/1965 | Leavell | 173/139 X |
| 3,232,669 | 2/1966 | Bodine | 299/37 |
| 3,339,641 | 9/1967 | Carter | 172/40 |
| 3,367,716 | 2/1968 | Bodine | 299/14 |
| 3,545,349 | 12/1970 | Otterman et al. | 404/133 X |

*Primary Examiner*—Ernest R. Purser
*Attorney, Agent, or Firm*—Townsend and Townsend

[57] ABSTRACT

A surface impact system including a mobile carrier vehicle is disclosed. A beam is provided having a resonant frequency with a pair of nodes spaced from the input and output ends of the beam and anti-nodes at each end and at the center. An oscillator is fixed to the input end of the beam to vibrate the beam at at least near its resonant frequency. The beam is mounted to the carrier vehicle at the node near the input end of the beam. A weight is superimposed over the beam at the node near the output end, and has a bearing surface adapted to bear downwardly against the beam at that node. The weight is coupled to the vehicle to control the vertical position of the weight. A tool depends from the output end of the beam, and strikes the surface on which the vehicle rests at the vibration frequency of the beam as the tool vibrates responsively to vibrations of the beam. The reaction force generated by the tool is substantially absorbed by the weight and not transmitted to the carrier vehicle.

11 Claims, 3 Drawing Figures

RESONANTLY DRIVEN VERTICAL IMPACT SYSTEM

BACKGROUND OF THE INVENTION

The present invention relates to a vertical impact system, and in particular to a system for breaking up a pavement surface, tamping on earth surface, or otherwise applying vertical impact forces to an underlying horizontal surface.

A variety of different pavement breaking and other types of surface impact tools are in use at the present time. Typically, such tools employ a heavy weight which is lifted and allowed to fall to provide the power stroke of the tool. Lifting of the weight for each stroke is generally inefficient, but more efficient solutions have not been available to date where large forces are necessary. Pneumatic and hydraulic tools are often used, but such tools are limited as to the amount of force that can be applied because the reaction forces on the tool are equal to those applied to the surface.

In the patent literature, the patent to Gettelman, U.S. Pat. No. 1,841,802, discloses a pick or tamping tool located at the end of a leaf spring supported at its center. This flexible spring, however, is insufficient to generate sufficiently large forces to break up most pavement, or provide a sufficient tamping action. Also, the large amplitudes involved render the device hard to control, and applicant has no knowledge that the Gettelman device has ever been successfully applied in practice.

Theoretical advantages in using resonant systems to apply large forces have been disclosed in the patent literature, as illustrated in U.S. Pat. Nos. 3,232,669 and 3,367,716, to Bodine. However, such resonant techniques apparently have not been successfully applied to vertical impact tools such as the type disclosed herein.

SUMMARY OF THE INVENTION

The present invention provides a surface impact system including a mobile carrier vehicle. A beam is provided having a resonant frequency with a pair of nodes spaced from the input and output ends of the beam and anti-nodes at each end and at the center. An oscillator is fixed to the input end of the beam to vibrate the beam at at least near its resonant frequency. The beam is mounted to the carrier vehicle at the node near the input end of the beam. A weight is superimposed over the beam at the node near the output end, and has a bearing surface adapted to bear downwardly against the beam at that node. The weight is coupled to the vehicle to control the vertical position of the weight. A tool depends from the output end of the beam, and strikes the surface on which the vehicle rests at the vibration frequency of the beam as the tool vibrates responsively to vibrations of the beam. The reaction force generated by the tool is substantially absorbed by the weight and not transmitted to the carrier vehicle.

In theory, resonant systems are supported at their nodes so that the input oscillatory forces are not transmitted to the supporting frame. However, the impact forces of the tool attached to the resonant system causes a reaction force which, at the resonant frequencies employed, is substantially constant. In typical past systems, the reaction force is transmitted directly to the supporting frame. The transmission of such a force to the frame is unacceptable for the relatively large forces generated by a surface impact tool such as that disclosed herein. However, the weight provided in the system of the present invention substantially absorbs the reaction force so that it is not transmitted to the frame. Preferably, the weight is supported by a single acting cylinder to further isolate reaction forces from the carrier vehicle.

In the present invention, it is preferred that the weight be significantly less than the input forces of the oscillator. Accordingly, if the tool encounters an obstacle which it is unable to penetrate, the weight will be lifted, moving the forward node position upwardly and allowing the system to continue to vibrate in a resonant mode. This flexibility avoids a forced vibration mode in which the location of the aft node moves, resulting in transmission of the oscillator forces directly to the frame with potential catastrophic consequences. In the preferred embodiment of the present invention, the oscillator motor is mounted on a frame which pivots along with the beam to preserve proper alignment.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
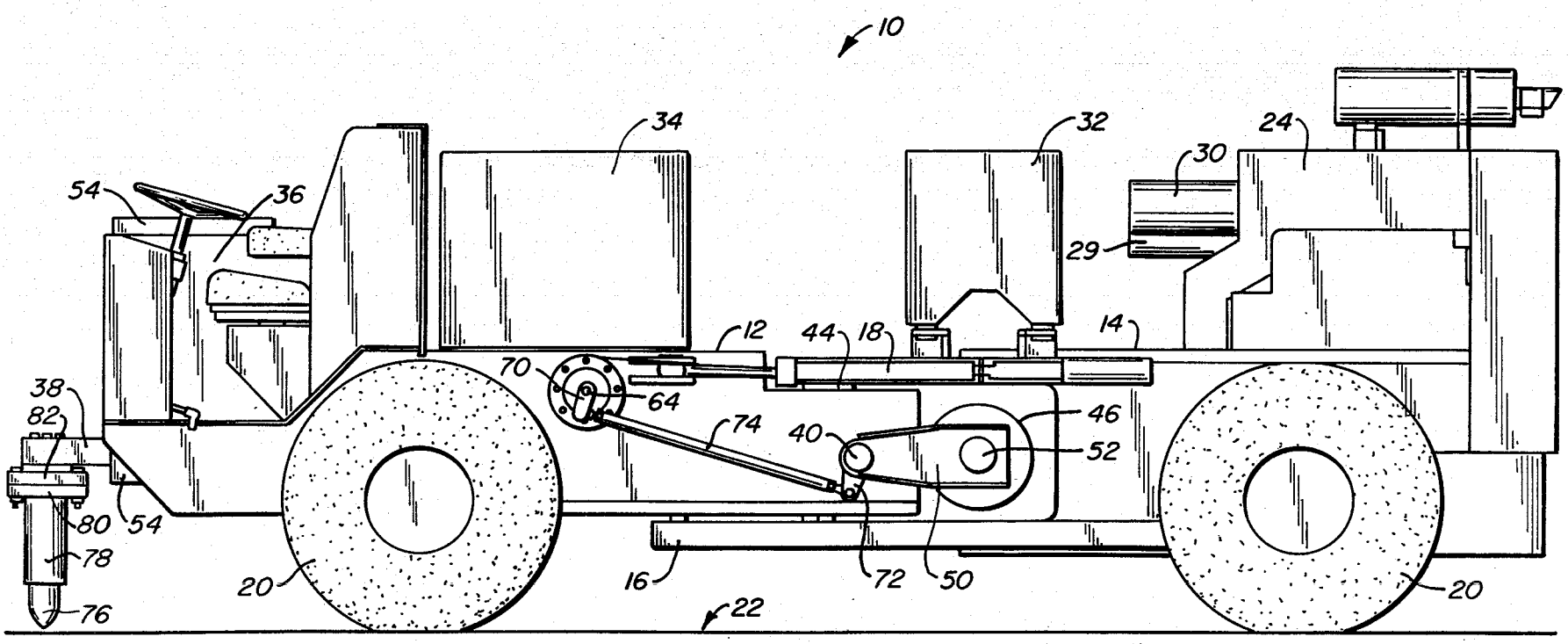
FIG. 1 is an elevation view of a preferred embodiment of the vertical impact system of the present invention.
Figure 2:
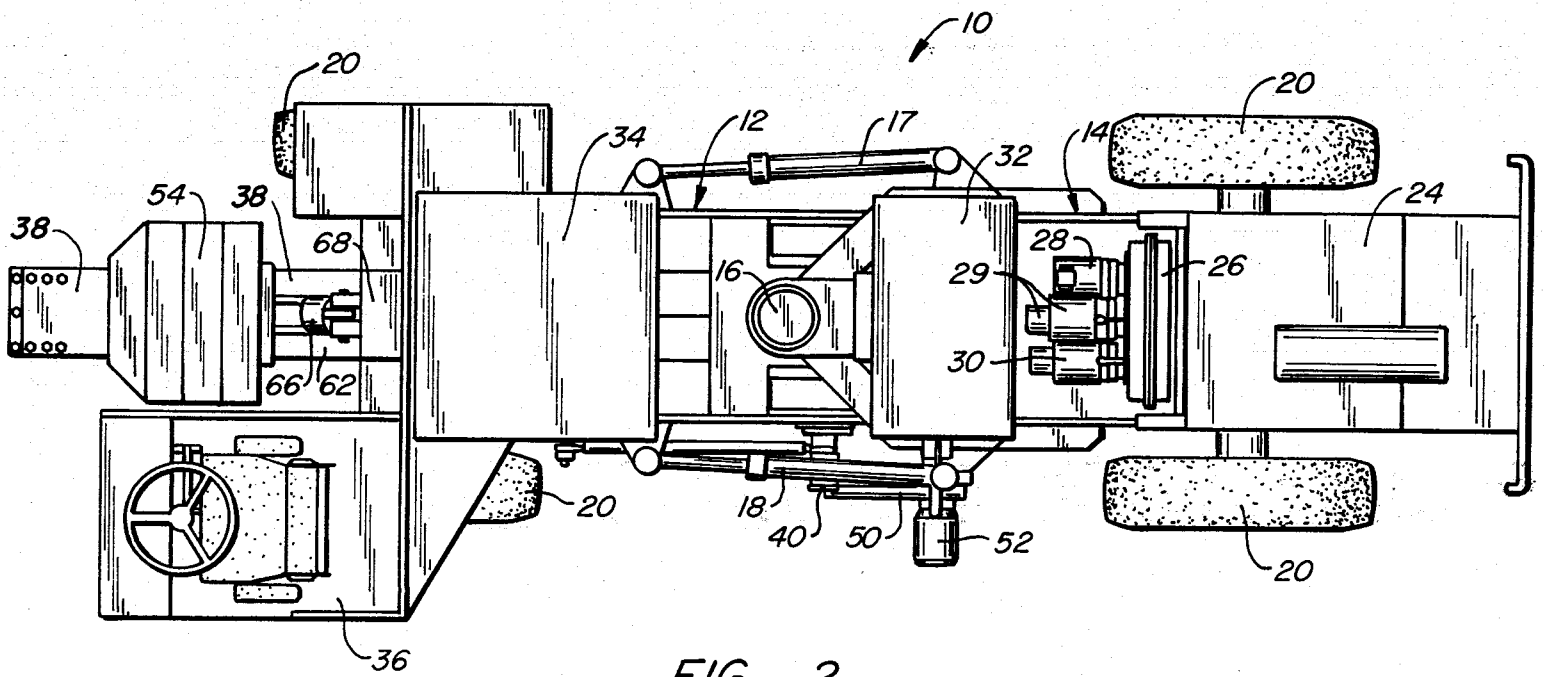
FIG. 2 is a plan view of the embodiment of FIG. 1.

The preferred embodiment 10 of the present invention is illustrated generally by way of reference to FIGS. 1 and 2 in combination. Impact system 10 includes a carrier vehicle with a forward frame 12 connected to a rear frame 14 by an articulating joint 16. Hydraulic actuators 17, 18 extend between forward and rear frames 12, 14 to control articulation of the vehicle. The carrier vehicle rides on wheels 20 over a surface 22 which is to receive vertical impact forces for some purpose, such as old pavement to be broken up and removed, a road bed to be tamped down, and the like.

An engine 24 is mounted on rear frame 14. Engine 24 drives a hydraulic output 26 operating three hydraulic pumps 28–30. A reservoir 32 for hydraulic fluid is provided adjacent pumps 28–30. One of the pumps 28–30 drives wheels 20 to propel the vehicle, one of the pumps is used to control the vehicle and operate its articulating cylinders 17, 18 and other control systems, and the third pump operates an eccentric weight oscillator to be described hereinafter.

The forward portion 12 of the vehicle includes a large fuel tank 34 located remote from engine 24. The operator of the vehicle rides in a control cab 36 projecting forwardly and to one side of the remainder of the vehicle.

Figure 3:
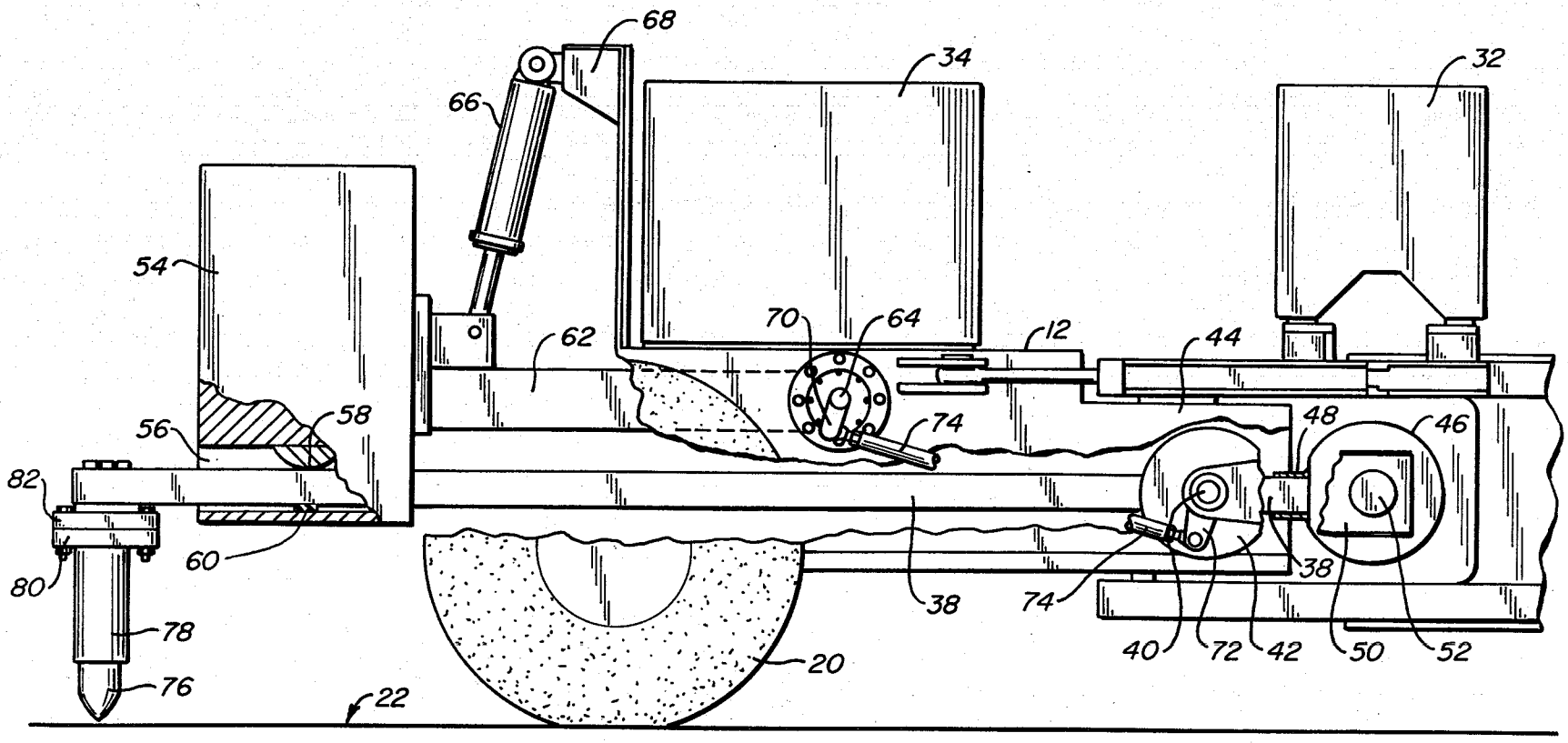
FIG. 3 is an elevation view of the embodiment of FIGS. 1 and 2 with portions broken away to illustrate the resonant system.

A solid, homogeneous resonant beam 38, typically steel, is supported by the carrier vehicle, as depicted in more detail by way of reference to FIG. 3. Beam 38 has a resonant frequency with forward and aft nodes spaced inwardly from its ends, and anti-nodes (locations of maximum amplitude) at its opposite ends and approximately at its center.

Resonant beam 38 is supported at its aft node by a shaft 40 penetrating the beam transversely at the location of the aft node. Shaft 40 is fixed to beam 38 and thus rotates with the beam. Shaft 40 is supported by resilient members such as 42 on opposite sides of the beam to isolate vibrations of the beam at the node from the surrounding frame. Resilient supports 42 are mounted on an extension 44 from forward frame 12 of the carrier vehicle which projects rearwardly beyond articulating joint 16.

Eccentric weight oscillator 46 is attached to the aft end of beam 38 by plates 48. A motor mount 50 is rotatably mounted to shaft 40, and projects rearwardly to a position to the side of oscillator 46. A hydraulic motor 52, powered by one of the pumps 28–30 is supported by motor mount 50, and drives eccentric oscillator 46 to apply eccentric forces to resonant beam 38.

Typically, motor 52 drives oscillator 46 at a frequency slightly below the resonant frequency of the beam. As eccentric weight oscillator 46 rotates, it applies a force to beam 38 which moves in a rotational fashion about the axis of the oscillator. The components of force applied axially to beam 38 are absorbed by the weight of the beam. Components of force normal to the axis of beam 38 cause the aft end of the beam to vibrate in an up and down motion, inducing a near resonant vibration of the entire beam about its node locations.

A massive weight 54 is superimposed over beam 38 toward its forward end. An aperture 56 is provided in the weight through which beam 38 passes. Weight 54 includes a bearing surface 58 bearing downwardly on the beam at its forward node location. The weight of the beam is supported by a transverse rubber strip 60 on the bottom surface of aperture 56.

Weight 54 is mounted on a pivot arm 62 pivotably mounted to forward frame 12 on shaft 64. Shaft 64 is fixed to arm 62 and rotates therewith. The vertical position of weight 54 is controlled by a single acting hydraulic cylinder 66 suspended from support 68 projecting upwardly from forward frame 12. Hydraulic cylinder 66 is single acting in that it is capable of supporting weight 54, but incapable of transmitting forces from the weight to support 68.

A bell crank arm 70 is nonrotatably mounted to shaft 64 supporting pivot arm 62. A similar bell crank arm 72 is nonrotatably mounted to motor mount 50. A rod 74 interconnects bell crank arms 70 and 72 so that the rotational positions of motor mount 50 and shaft 64 coupled to the forward node of the beam by weight 54 are interdependent. As a result, vertical movement of the forward node of resonant beam 38 is transmitted through arm 74 to rotate motor mount 50 to maintain motor 52 aligned with the axis of oscillator 46.

A tool 76 is supported on a tool sleeve 78 terminating in a flange 80. Flange 80 is bolted to a corresponding flange 82 depending from the underside of the forward end of resonant beam 38. At the neutral or rest position of tool 76, it is slightly above surface 22. In the embodiment illustrated, tool 76 is pointed, and represents, for example, a tool for breaking up old pavement so that it can be removed. However, tool 76 can be of a variety of types used to transmit vertical impact forces to an underlying surface, such as a tamping tool to harden a road bed.

A situation to be avoided in the operation of a resonant system is one in which downward movement of tool 76 relative to its neutral position is prevented, such as when system 10 encounters an upwardly inclined surface. If tool 76 cannot move downwardly from its neutral position, it essentially becomes locked in place, converting the forward end of beam 38 to a node and changing the vibrational characteristics of the beam. To prevent this situation from occurring, the size of weight 54 is significantly less than the input forces of oscillator 46. A weight of 6,000 lbs. and oscillator force of 10,000 lbs. would be typical. Accordingly, when tool 76 encounters such an obstacle, the reaction forces will overpower weight 54, causing the weight to lift, shifting the forward node location upwardly and allowing the resonant beam to continue to vibrate in its near resonant mode.

In operation, oscillator 46 supplies forces to resonant beam 38 to cause the resonant beam to vibrate at least near its resonant frequency. At that frequency, the beam exhibits two nodes, an aft node at the location of support shaft 40, and a forward node underlying bearing surface 58 of weight 54. Tool 76 vibrates vertically about its neutral position, and strikes the underlying surface 22 on its downward stroke to perform the desired function.

In viewing FIG. 3 it is evident that resonant beam 38 is supported only at two positions, namely, at its aft node on shaft 40 and at its forward node by weight 54. Since the node locations are basically stationary when the beam is operating in its near resonant mode, the fact that the beam is vibrating does not cause significant vibrational forces to be transmitted from the beam to the supporting vehicle.

The impact of tool 76 on underlying surface 22 results in the application of an upwardly directed reaction force on beam 38. These reaction forces are transmitted almost entirely to weight 54 by way of bearing surface 58. These reaction forces are substantially absorbed by the weight, and are not transmitted to the frame through single acting cylinder 66. As a result, operation of the resonant system is substantially isolated from the carrier vehicle, and large impact forces can be exerted on surface 22 without corresponding reaction forces being exerted on the carrier vehicle.

While a preferred embodiment of the present invention is illustrated in detail, it is apparent that modifications and adaptations of that embodiment will occur to those skilled in the art. However, it is to be expressly understood that such modifications and adaptations are within the spirit and scope of the present invention, as set forth in the following claims.

What is claimed is:

1. A surface impact system comprising:

a mobile carrier vehicle;

a beam having a resonant frequency with a pair of nodes spaced from the ends of the beam and anti-nodes at each end comprising input and output ends respectively and at the center of the beam;

an oscillator fixed to the input end of the beam to vibrate the beam at at least near its resonant frequency;

means for mounting the beam to the carrier vehicle substantially at the node near the input end of the beam;

a weight superimposed over the beam at the node near the output end and having a bearing surface adapted to bear downwardly against the beam at said node;

means for coupling the weight to the vehicle to control the vertical position of the weight, said means for coupling being arranged so that upward forces caused by the tool striking the surface are not transferred to the vehicle; and a tool depending from the output end of the beam and adapted to strike the surface underlying the vehicle at the vibration frequency of the beam as the tool vibrates responsively to vibrations of the beam, generating a reaction force which is substantially absorbed by the weight and not transmitted to the vehicle.

2. The system of claim 1 wherein the weight includes a support member underlying the beam to support the weight of the beam at the node near the output end.

3. The system of claim 1 wherein the size of the weight is significantly less than the forces exerted by the oscillator on the beam so that the weight moves upwardly when the tool encounters an obstacle and prevents the beam from entering a forced vibration mode.

4. The system of claim 1 wherein the beam comprises a solid, homogeneous metal member.

5. A surface impact system comprising:

a mobile carrier vehicle;

a solid beam having a resonant frequency with a pair of nodes spaced from the ends of the beam and anti-nodes at each end comprising input and output ends respectively and at the center of the beam;

an oscillator fixed to the input end of the beam to vibrate the beam at at least near its resonant frequency;

means for mounting the beam to the carrier vehicle substantially at the node near the input end of the beam so that the beam is pivotable with respect to the carrier about a horizontal axis passing through said node;

a weight superimposed over the beam at the node near the output end and having a bearing surface adapted to bear downwardly against the beam at said node and a support surface to support the weight of the beam, the size of said weight being significantly less than the input forces of the oscillator to allow the oscillator to move the weight;

means for suspending the weight from the vehicle to control the vertical position of the weight, said suspending means supporting the said weight without transferring upward forces from the weight to the vehicle; and a tool depending from the output end of the beam and adapted to strike the surface underlying the vehicle at the vibration frequency of the beam as the tool vibrates responsively to vibrations of the beam, generating a reaction force which is substantially absorbed by the weight and not transmitted to the vehicle.

6. The system of claim 1 or 5 wherein the suspending means comprises a single acting cylinder capable of supporting the weight but incapable of transmitting upward forces from the weight to the vehicle.

7. The system of claim 1 or 5 wherein the vehicle has an articulated frame, and the beam is supported by the forward portion of the articulated frame.

8. The system of claim 1 or 5 wherein the oscillator comprises an eccentric weight oscillator.

9. The system of claim 1 or 5 wherein the beam mounting means includes a motor mount mounted to the vehicle along the axis of the node near the input end of the beam and extending to a position proximate the axis of the oscillator, and wherein the oscillator includes a drive motor fixed to said motor mount.

10. The system of claim 9 wherein the motor mount is operatively coupled to the weight so that the motor mount pivots responsively to movement of the weight.

11. The system of claim 10 wherein the coupling means includes a pivot arm attached to the weight and allowing vertical movement of the weight relative to the vehicle, and wherein the pivot arm is operatively coupled to the motor mount.

* * * * *